United States Patent [19]

Showalter

[11] Patent Number: 4,472,323

[45] Date of Patent: Sep. 18, 1984

[54] METERING SYSTEM

[75] Inventor: Merle R. Showalter, Madison, Wis.

[73] Assignee: Automotive Engine Associates, Madison, Wis.

[21] Appl. No.: 406,968

[22] Filed: Aug. 10, 1982

[51] Int. Cl.[3] ..... F02M 7/22

[52] U.S. Cl. ..... 261/50 R; 261/DIG. 74; 261/69 R; 261/67; 123/458

[58] Field of Search ..... 123/458, 463, 512; 261/DIG. 74, 50 R, 67, 69 A

[56] References Cited

U.S. PATENT DOCUMENTS

| | | | |
|---|---|---|---|
| 2,943,614 | 7/1960 | Bosch et al. | 123/458 |
| 3,319,613 | 5/1967 | Begley et al. | 123/458 |
| 3,776,208 | 12/1973 | Stumpp | 261/DIG. 74 |
| 3,949,714 | 4/1976 | Mitchell | 123/458 |
| 4,050,428 | 9/1977 | Masaki | 261/69 R |
| 4,130,095 | 12/1978 | Bowler et al. | 261/DIG. 74 |
| 4,187,814 | 2/1980 | Phelan et al. | 261/DIG. 74 |
| 4,208,358 | 6/1980 | Atkins et al. | 261/DIG. 74 |
| 4,318,868 | 3/1982 | Showalter et al. | 261/50 R |

*Primary Examiner*—Tim R. Miles

*Attorney, Agent, or Firm*—Witherspoon & Hargest

[57] ABSTRACT

A fuel/air metering system with an air throttle valve and fuel valve positively linked with the flow crossectional area of each valve proportional to the other. The air pressure drop across the air throttle valve is sensed and a corresponding fuel pressure drop is computed. A servo valve in series with the fuel valve is controlled so that the pressure drop across the fuel valve corresponds to this computed value.

1 Claim, 3 Drawing Figures

METERING SYSTEM

BACKGROUND AND OBJECTS

A metering system employing exact fluid mechanical equations has been patented by the current inventor along with J. Wray Fogwell and John M. Clark, Jr., and is described in U.S. Pat. No. 4,318,868. In the course of development of this metering system, a number of mechanical problems involving inconvenience and production expense have come up. In the previous patent, it was shown in mathematical detail that an excellent proportioning of fuel to air could be obtained with a metering system having a fuel valve opening exactly proportioned to the air throttle opening and holding the pressure drop across the fuel valve proportional to the square of the mass flow per unit area past the air throttle. A two-orifice in series analog passge was shown to be capable of supplying the control signal for this. An important part of the metering system was a hydropneumatically controlled servo valve arrangement which controlled the pressure drop, and hence the fuel flow across the fuel metering valve linked to the air throttle. This servo valve held the pressure drop across the metering fuel valve in a relation such that it was proportional to the pressure drop across an upstream orifice in a two-orifice in series metering air flow passage. It is the purpose of the present invention to replace the hydropneumatic control arrangement described in U.S. Pat. No. 4,318,868 with an electrical fuel flow control servo arrangement which electrically senses the pressure drop across the air throttle, computes the proper pressure drop across the fuel valve which corresponds to this air throttle pressure drop and controls a simple electrical servo valve to produce this fuel pressure drop as measured with a fuel pressure sensor across the fuel valve. The electrical control system has the advantages of flexible electronic computation, high speed, and greater mechanical simplicity. The system is adaptable to various feedback controls which can be fed into the electronics without additional mechanical complexity.

IN THE DRAWINGS

FIG. 1 shows the fuel circuit, with the fuel metering valve linked to the air throttle interupting a fuel passage across which there is a fuel pressure sensing means, and with fuel flow past the fuel metering valve feeding past a solenoidal servo valve to the engine. Changing the current across the solenoid of the solenoidal servo valve changes the pressure drop across the solenoidal servo valve in proportion to the magnetic force on the servo valve plate, and therefore changes pressure drop across the primary fuel metering valve and therefore changes fuel flow to the engine.

DETAILED DISCUSSION

Figure 1:
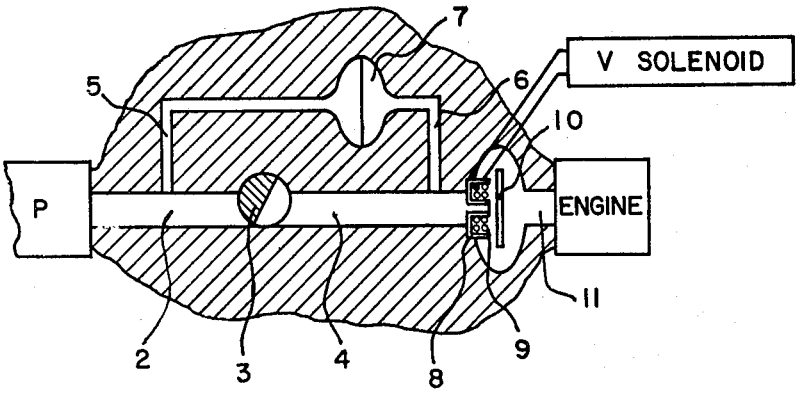

See FIG. 1. Pressurized fuel from pressurizing means 1 (which may include the combination of a fuel pump and an accumulator to supply a smooth pressurized source of fuel) feeds a fuel passage 2 which is closed off by a variable fuel metering valve 3 which is linked to the shaft of the air throttle. Fuel valve 3 is analogous to the fuel valve shown in U.S. Pat. No. 4,318,868, and is constructed in detail as is described in that patent. Fuel flowing past variable area metering valve 3 flows into passage 4 which is closed off via variable restriction solenoidal servo valve 8, 9, 10 which feeds passage 11 which feeds the engine. The pressure drop between passage 2 and passage 11 is divided between metering valve 3 and solenoidal valve 8, 9, 10. Control of the current through servo valves 8, 9, 10 therefore controls the pressure drop and the fuel flow past metering valve 3 and supplied to the engine. When the fuel flow past metering valve 3 is correct, there is a particular pressure drop between passage 2 and passage 4. This pressure drop is measured with an electrical fuel pressure differential meter (for example a fuel diaphragm with a capacitance position sensor). Such a pressure sensitive meter is shown as 7, and is fed with an upstream pressure port 5 in communication with passage 2 and a downstream pressure port 6 in communication with passage 4.

Figure 2:
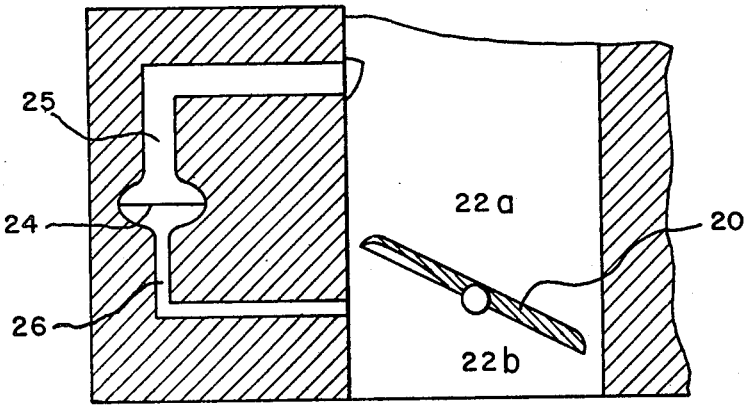
FIG. 2 shows in schematic form an air throttle (linked directly to the fuel metering valve, and a pressure sensing means sensing the pressure drop across the air throttle).

FIG. 2 shows schematically an air throttle, mounted on the same shaft as the fuel metering valve 3 in a manner precisely analogous to that shown in U.S. Pat. No. 4,318,868. Air throttle valve 20 is mounted in passage 22, which is the air flow passage supplying the engine. Passage 22A is upstream of the air throttle, and passage 22B is downstream of the throttle at a lower pressure than 22A when air flow is feeding the engine. Pressure in passage 22A is picked up by passage 25, which supplies a diaphragm 24. The downstream pressure on diaphragm 24 is the same as the dynamic pressure measured by passage 26 on the wall of passage 22B, so that the pressure drop across diaphragm 24 is the pressure drop across the air throttle, ΔP air. This pressure drop can be measured by any of a number of pressure sensitive means, for example, a capacitance position sensor measuring diaphragm deflection. An electrical signal from this sensor will be the measure of ΔP air supplied to the electronic logic.

Figure 3:
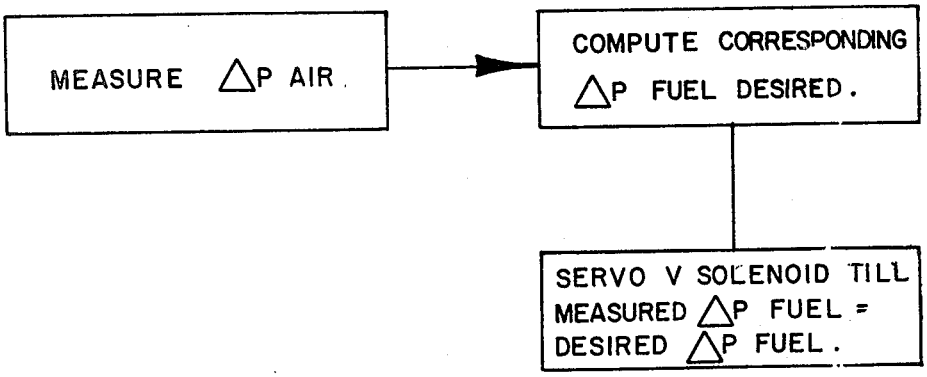
FIG. 3 shows schematically the control arrangement of the fuel control.

FIG. 3 shows schematically the electronic logic. An electronic computing means takes the measure of ΔP air and computes the desired valve of ΔP fuel according to a lookup table or analytical equations such as those described in detail in U.S. Pat. No. 4,318,868. Because the coefficient of discharge of the air throttle and the fuel throttle are precisely matched, a given ΔP air corresponds to a specific and unique ΔP fuel, except for relatively small slow moving multiplicative corrections called R. These corrections can be fed into the computation (for example, with an $O_2$ sensor or a roughness sensor means). The computer, on the basis of the measured ΔP air and the correction functions (if any), computes a ΔP fuel required of the system if the equations analogous to those shown in U.S. Pat. No. 4,318,868 are to be satisfied. The electronics then varies the voltage to the solenoid valve in a negative feedback servo mechanical fashion until the measured ΔP fuel is equal to the computed ΔP fuel. This servo control can be accomplished very quickly (in less than 5 milliseconds) and the control of the servo valve is stable if the servo and one of the legs of the fuel pressure sensor (either passage 5 or 6) has sufficient damping to make the system critically damped.

The system therefore achieves electronically the relation $\Delta P$ fuel$=Rf(\Delta P_a$air) which is what is required in a metering system where the fuel metering valve and the air throttle have matched effective passage areas at all throttle angles in the manner described in U.S. Pat. No. 4,318,868.

I claim:

1. In a fuel/air metering system having a fuel metering valve having an effective fuel flow area varying in proportion to the effective flow area of an air throttle valve:

a. source of pressurized fuel upstream of said fuel metering valve, b. a passage means downstream of said fuel metering valve, c. feeding fuel to a receiver, d. a fuel servo valve in series with said fuel metering valve for varying the pressure drop across said fuel metering valve, $\Delta P_{air}$ means to measure the pressure drop directly across the air throttle valve, $\Delta P_{fuel}$ means to measure the pressure drop directly across said fuel metering valve, and electronic computing and servo controlling means employing said measured pressure drops to control the opening and closing of the fuel servo valve to control fuel pressure drop across said metering valve to satisfy the relation, $$\Delta P_{fuel} = Rf(\Delta P_{air})$$

* * * * *